US005158527A

United States Patent [19]

Bernard

[11] Patent Number: 5,158,527

[45] Date of Patent: Oct. 27, 1992

[54] METHOD AND APPARATUS FOR MECHANICALLY JOINING CONCRETE-REINFORCING RODS

[75] Inventor: Alain Bernard, Marcq-en-Baroeul, France

[73] Assignee: Techniport S.A., Marcq-en-Baroeul, France

[21] Appl. No.: 302,201

[22] Filed: Jan. 27, 1989

[30] Foreign Application Priority Data

Feb. 3, 1988 [FR] France ..... 88 01611
Nov. 14, 1988 [FR] France ..... 88 15472

[51] Int. Cl.[5] ..... F16B 7/18

[52] U.S. Cl. ..... 403/305; 403/307; 403/343; 52/726

[58] Field of Search ..... 403/307, 305, 43, 47, 403/279, 343, 342, 360; 72/89; 29/452; 52/726

[56] References Cited

U.S. PATENT DOCUMENTS

| | | | |
|---|---|---|---|
| 1,085,515 | 1/1914 | Wills | 403/343 X |
| 2,186,482 | 1/1940 | Frank | 403/307 |
| 3,327,380 | 6/1967 | Howlett | 403/307 X |
| 3,415,552 | 12/1968 | Howlett | 403/305 |
| 3,850,535 | 11/1974 | Howlett et al. | 403/305 |
| 4,143,986 | 3/1979 | Antosh | 403/307 |
| 4,241,490 | 12/1980 | Edwards | 403/279 X |
| 4,484,833 | 11/1984 | Gallagher, Jr. | 403/343 X |
| 4,500,224 | 2/1985 | Ewing | 403/343 |
| 4,752,151 | 6/1988 | Ashida et al. | 403/307 X |
| 4,769,886 | 9/1988 | Berchem et al. | 29/452 X |
| 4,799,307 | 1/1989 | Reigstad et al. | 29/452 |
| 4,819,469 | 4/1989 | Kies et al. | 72/89 |
| 5,067,844 | 11/1991 | Bowmer et al. | 403/305 |

FOREIGN PATENT DOCUMENTS

| | | |
|---|---|---|
| 0190989 | 1/1986 | European Pat. Off. . |
| 1750177 | 8/1957 | Fed. Rep. of Germany . |
| 8600406 | 6/1986 | Fed. Rep. of Germany . |
| 1047189 | 12/1953 | France . |
| 1459978 | 11/1966 | France . |
| 1546253 | 5/1979 | United Kingdom . |

*Primary Examiner*—Peter M. Cuomo
*Attorney, Agent, or Firm*—Sandler, Greenblum, & Bernstein

[57] ABSTRACT

The invention relates to a method for producing mechanical joints of concrete-reinforcing rods, to a reinforcing rod allowing the application of the method as well as to a mechanical joint for reinforcing rods thus produced. It has its applications especially in the construction of concrete elements, buildings or structures.

According to the invention, the method for producing the mechanical joints for the reinforcing rods which allow the joining of reinforcing rods, the extremities of which are threaded by screwed connecting sleeves, is characterized in that prior to the threading, the extremity of the rods to be joined is subjected to a cold upsetting procedure.

27 Claims, 2 Drawing Sheets

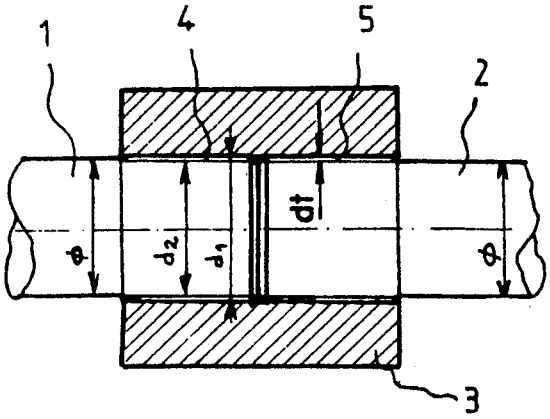
FIG.1
FIG.2
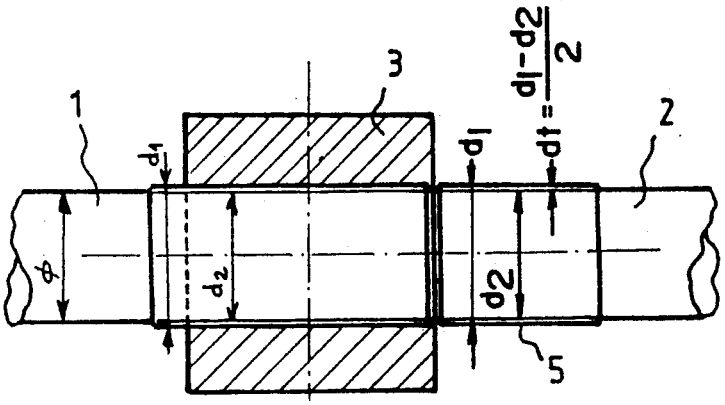
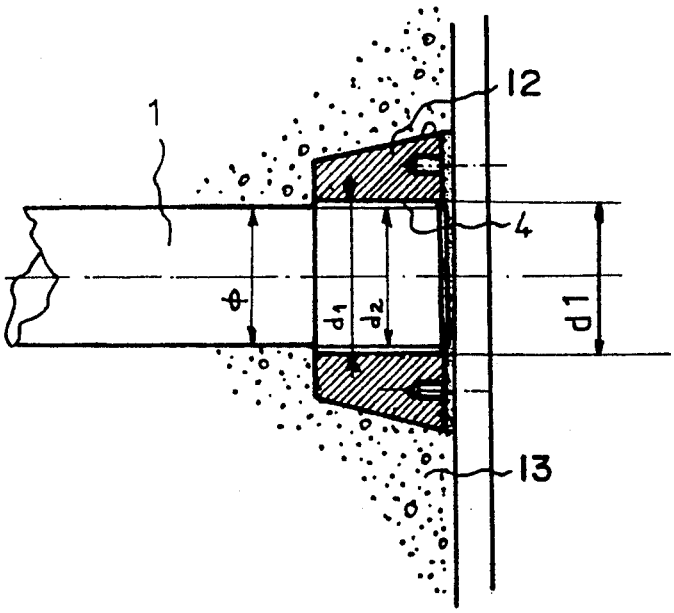
FIG. 3

METHOD AND APPARATUS FOR MECHANICALLY JOINING CONCRETE-REINFORCING RODS

BACKGROUND OF THE INVENTION

1. Field of the Invention

The invention relates to a method for mechanically joining concrete-reinforcing rods, to a reinforcing rod, allowing the application of said method as well as to a mechanical joint of reinforcing rods thus produced. The invention is applicable in particular in the construction of concrete building components or concrete structures.

2. Discussion of Background and Relevant Information

Currently, such reinforcing rods are connected by way of joints having the function of transmitting the tensile stress; in addition, the joint must be easy to set in place and be of a low cost. Various solutions have been proposed by constructors to bring about the mechanical joining of reinforcing rods.

There exists first of all the overlap joint system. This method has several drawbacks. In particular, it is necessary to leave pending a relatively big length of the reinforcing rod, up to two meters, for example, in order to subsequently produce the joint, which is troublesome and difficult and often even impossible to fold back by reason of the large diameters encountered.

Another proposed method consists in utilizing a mechanical joint. There is known for example the system of conical threading in which the extremities of the rods to be joined are machined to have the shape of a conical thread, by means of which they can be inserted and screwed into a connector to be embedded in a block of concrete.

This solution suffers from numerous drawbacks. In particular, the conical threading is effected on a solid bar at the nominal diameter of the reinforcing rod. The machining of the thread diminishes locally the cross-section of the bar which then corresponds substantially to the cross-section at the bottom of the thread.

During tensile tests, the rupture of the reinforcing rod always occurs at its extremity in the threaded zone. Consequently, it cannot be doubted that this method of mechanical jointing weakens the reinforcing round, which must be overdimensioned accordingly to take into account the local weakness in the threaded region.

Nor does this system allow the use of a simple connecting sleeve with right-hand and left-hand thread to constitute the joint with adjustment of tension. It is necessary to employ several parts to constitute a stack and allow for adjustment of length.

Lastly, the tightening of the sleeve on the conical thread must be effected with a preset torque, which has to be monitored. This operation is not easy to perform on a construction site, but it is nevertheless indispensable for safety reasons: If the tightening torque is not achieved, there are risks of dislocation and a total absence of resistance to traction.

From an economic point of view, this is an expensive solution, because the machining of the sleeve is a complex operation and, in particular, the thread must be cut in two stages.

In conclusion, this technique necessitates an overdimensioning of the diameters of the reinforcing rods of the order of 20%, in order to withstand the stresses which concentrate at the threaded extremities of the resulting in high costs.

Another mechanical joint has also been used. This consists in a crimping of the extremities of the reinforcing rods to be joined. To this end, there is employed a socket into which are inserted the two extremities of the reinforcing rods. The socket is then crimped on the rods with the aid of a jack and a press.

This technique is fraught with high risks of slippage owing to the crimping which is far from easy to achieve and difficult to control. This defect considerably reduces the mechanical strength of the joint. On a construction site, it is often difficult to position a press level with the socket to be crimped. Also, the use of a press is costly.

Further, with regard to the regulations governing the use of such mechanical joints of reinforcing rods it is of course prescribed that the latter must be able to withstand ultimate rupture stress and certain Countries, especially the Anglo-Saxon Countries, impose very rigorous slippage-control standards.

In Great Britain, for example, Standard BS-81 10: part 1; 1985-3.12.8.16.2 specifies that reinforcing rods assembled by means of a connecting sleeve must be able to withstand a tensile test in which the rods are subjected to a stress corresponding to 60% of the elastic limit, following which the permanent elongation may not exceed 0.1 mm.

These standards are even more rigorous in some other countries. For example, in the United States, the stress applied corresponds to 80% of the elastic limit. Similar tests are also applied in the nuclear industry.

These tests, when carried out on a site, are difficult to put into effect, requiring the use on the site of torque wrenches, which increases the cost of the finished joint.

Moreover, if the machining of the different components has not been carried out with precision, it may happen that during subsequent testing the mechanical joint does not satisfy these standard specifications. It is then necessary to start all over again, which is affects production costs. On the other hand, precision fabrication requires a highly skilled workforce and special attention to detail of such an order that the solution ceases to be an economically viable one.

SUMMARY OF THE INVENTION

The principal object of the present invention is to provide a method for effecting the mechanical joining of reinforcing rods, a reinforcing rod allowing the application of method as well as a mechanical joint of reinforcing rods thus produced which offer the advantages of a high degree of safety in use, ease of application and competitive cost, whilst remedying the disadvantages of the known systems.

In terms of the present invention, with regard to safety of usage, the tensile tests carried out have shown that the rupture always occurs in the solid bar and to not at in the zones of the mechanical joints, as has been traditionally the case. Accordingly, the mechanical joint of the present invention does not constitute a zone of weakness.

Furthermore, the ease of application is achieved by means of a threaded connecting sleeve. This method allows in particular a positional adjustment of the rods and the amount of tightening equipment is limited, which is particularly advantageous for on-site use.

In economic terms, the method of the present invention involves only a limited amount of machining and the utilization of conventional non-constraining means.

One object of the present invention is to propose a method for producing mechanical joints for reinforcing rods, a reinforcing rod allowing the application of said method and to a mechanical joint of reinforcing rods thus produced, which allow to satisfy very rigorous deformation criteria imposed by certain standards or regulations, which specify testing up to 80% of the elastic limit.

Another object of the present invention is to propose a method for producing mechanical joints for reinforcing rods which allow to provide mechanical joints in which all the threaded rods are tested, which is of fundamental importance in terms of quality conrol and which provides for an important structural guarantee.

Whilst hitherto the known techniques did allow to produce mechanical joints, only those parts could be considered reliable which have been tested. The present invention constitutes an important step towards a 100% reliability, due to the fact that all the rods are tested.

Other objects and advantages of the present invention shall be exposed in the following description which, however, is given only by way of an example and which is not intended to limit the invention in any way.

According to the invention, the method for producing mechanical joints of reinforcing rods, which is applicable particularly in the construction of concrete elements or structures, by means of which reinforcing rods can be joined, the extremities of which are threaded by means of tapped connecting sleeves, is characterised in that prior to the threading of the extremity or extremities of the reinforcing rods to be joined are treated by cold upsetting.

The reinforcing rod, allowing the application of the method according to the invention, is characterised in that it has at least one threaded upset extremity.

The mechanical joint of the reinforcing rod, produced by the application of the method according to the invention, in which two reinforcing rods are joined substantially coaxially by the intermediary of a threaded connecting sleeve, is characterised in that the extremity or extremities of the rods to be joined have a thickening in the zone of the threaded portion for reinforcing purposes.

BRIEF DESCRIPTION OF THE DRAWINGS

The invention will be better understood from the following description made with reference to the accompanying drawings, in which:

FIG. 1 diagrammatically illustrates the joint of two reinforcing rods according to one mode of application of the present invention, FIG. 2 illustrates the mechanical joint of fixed reinforcing rods, FIG. 3 illustrates a third example of a mechanical joint for reinforcing rods in the zone of an anchoring point.

DETAILED DESCRIPTION OF A PREFERRED EMBODIMENT

Figure 4:
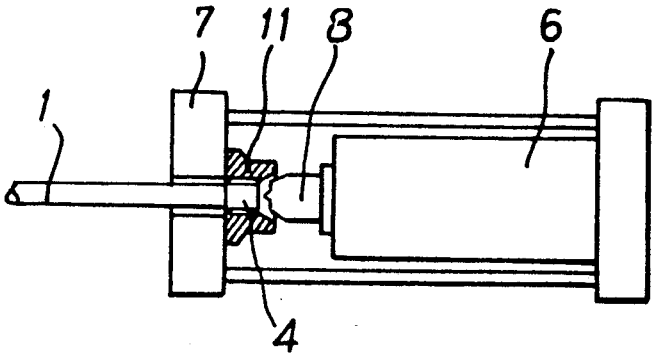
FIG. 4 shows diagrammatically a prestressing device for the reinforcing rods according to the present invention.

The present invention has for object a method for embodying the mechanical joint of reinforcing rods, a reinforcing rod allowing the application of the method, as well as a mechanical joint of reinforcing rods thus conformed which will find applications especially in the construction of concrete elements, buildings or structures.

In this field of activity, there are employed tension pieces which pass through concrete elements completely and which are tensioned to generate a compressive stress in the concrete. The adjustment of the tensile stress and the choice of location of the tension pieces must be carefully determined by calculation.

In practice, the tension pieces are formed by an assembly of reinforcing rods placed end to end. The joint employed to integrate the reinforcing rods must be capable of absorbing the tensile stress, and must be easy to set in place whilst also being economical to produce.

Currently, various solutions are being proposed, such as overlap joints or crimped joints, but these involve high-cost requirements in their application and have numerous disadvantages.

The mechanical joint according to the present invention allows to effect a substantially coaxial, end to end assembly of two reinforcing rods 1 and 2, as illustrated in FIG. 1. A threaded connecting sleeve 3 is utilized to receive the threaded extremities 4 and 5, respectively, of the reinforcing rods 1 and 2.

With regard to the threading and tapping, two solutions may be considered, namely: the use of the extremities of the bars having the same right-hand or left-hand thread, in which case it is necessary to achieve a tightening by rotation of the bar 1 or 2; alternatively the use of the threaded extremities 4 and 5 having inverse right-hand and left-hand threads and the same for the appropriately tapped sleeve 3, in which case the tightening is achieved by rotation of the connecting sleeve 3. In this regard, the application of the present invention has no restrictions.

However, if a simple thread is produced at the extremity of the reinforcing rods 1 and 2, tensile tests show that the rupture of the bars always occurs in the threaded zone of one of the bars. This phenomenon can be explained by the fact that the cross-section of the bar is reduced at this location. In fact, the threading produced on the surface of a reinforcing rod cuts into the section and, as the latter becomes smaller, a weakening results.

With the mechanical joint of the present invention, a reinforcement of the extremity of the reinforcing rod is produced, in such a manner, that the latter is stronger than the central portion of the bar.

Thus, under tensile load, a rupture occurs in the central portion of the bar and not at the level of the joint. The choice of the section of the reinforcing rod can be made as a function of the required strength to be obtained in the central part of the bar and not in the weakened portion of the joint as is conventionally the case. At equal mechanical strength, the reinforcing rods employed within the scope of the present invention will have a smaller cross-section, which permit one to achieve a substantial cost savings.

According to the principal feature of the present invention, the reinforcement of the extremity of the reinforcing rod to be joined is achieved, prior to threading, in a cold-upsetting operation.

It is appropriate here to insist on the distinctive character of the operation contrary to the practices customary in this field. The conventional cold-upsetting technique aims at obtaining dimensional modifications of the machined part in excess of 30%. For example, a diameter of 40 mm, after cold-upsetting by the conventional methods, results in a diameter of the order of 55 mm. However, such a deformation of the material does not bring about the expected results and leads to a loss of mechanical strength. This loss is essentially localised within the zone of diameter change. Tensile tests show that ruptures occur in this region.

According to the present invention, the extremity is reinforced over the threaded length in a cold-upsetting operation, which brings about an increase in diameter equal to or less than 30%, in particular an increase in diameter of between 10 and 30%.

This value allows one to achieve both an increase in mechanical strength due to a cross-section increase and also a small increase of internal stress so as not to weaken the reinforcing rod in the zone of diameter change.

Table 1 indicates, by way of example, the values of diameter $d_1$ of the upsetting to be achieved prior to threading as a function of the nominal diameter $\phi$ of the bar used, giving good practical results.

TABLE 1

| $\phi$ nominal mm | $d_1$ thread mm | $\frac{d_1 - \phi}{\phi}$ |
|---|---|---|
| 16 | 24 | 20% |
| 20 | 24 | 20% |
| 25 | 30 | 20% |
| 32 | 36 | 12% |
| 40 | 45 | 12% |
| 50 | 56 | 12% |
| 56 | 64 | 14% |

The tabulated values show that in terms of percentage the cold upsetting may diminish as the diameter of the bar increases. The cross-section of the reinforcing rods at the bottom of the thread, $d_2$ of the upset extremity must be at least slightly greater than the overall section $\phi$ of the reinforcing rod to be joined. In other words, the threads produced will have a depth $d_t$, defined as $[d_1-d_2]/2$.

The upsetting operation according to the present invention is to be preferably carried out cold. Actually, a hot upsetting has the drawback of weakening the transition zone by reason of the uncontrolled cooling. In general, there results an over-tempering which weakens the metal. Moreover, the hot process has to be applied outside the construction site because it requires furnaces which have to be supplied with power which is often not available on the work site.

Given that the concrete-reinforcing rods are generally produced in steels with high carbon and manganese content, they are very sensitive to thermal shocks so that cold-upsetting is preferred.

The length of the threading produced at the extremity of the concrete-reinforcing rods should substantially correspond to the diameter of the rod in order to achieve a safety margin, given that threaded lengths of 0.7 times the diameter are sufficient to resist tension. However, this length may be greater.

The mechanical joint according to the present invention could also be applied in the case of fixed reinforcing rods, which cannot be pulled apart, as illustrated in FIG. 2. In this case, one of the bars 1 has a threading 4 of double length produced about an upset extremity, and the sleeve 3 initially placed around the thread 4 will be displaced by rotation to cover the threaded portion of the reinforcing rods 2. The threads 4 and 5 will have the same pitch.

It is also necessary that the application of the mechanical joint according to the present invention may equally be established at the anchoring points of the profiles 1, as is illustrated in FIG. 3. In this case, the threaded extremity 4 of the reinforcing rod should be previously treated by cold-upsetting in order to reinforce it, and this extremity is fixed in an anchoring socket 12 integral with the concrete block 13.

Moreover, in order to withstand the tensile tests imposed by certain safety standards, the extremity 4 and/or 5, reinforced by upsetting, is prestressed.

This prestressing allows one to cancel out all the displacements and elongations of the concrete-reinforcing rods and especially those of their extremities in the safety tests applied.

In addition, due to this prestressing, it will not be necessary to employ torque wrenches on the construction site or to produce the threads with a high mechanical precision.

Thus, in order to realize the mechanical joints of the concrete-reinforcing rods according to the present invention, the following procedure is to be adopted:

prior to threading, the extremity or the extremities 4, 5 of the concrete-reinforcing rods 1, 2 to be joined are subjected to cold upsetting;

following this, the threading of the upset extremity or extremities 4, 5 is carried out by conventional methods;

lastly, the upset threaded extremity or extremities 4, 5 of the concrete-reinforcing rounds are prestressed prior to the mounting of the joint on the site.

Figure 5:
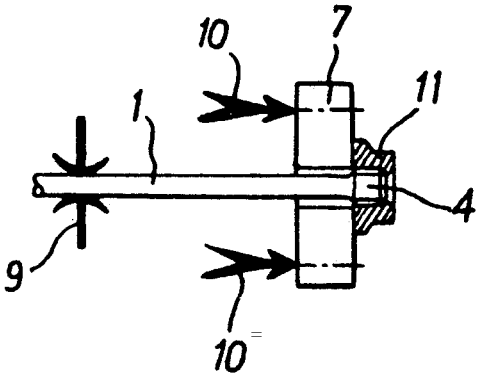
FIG. 5 is a diagrammatic illustration of a variant embodiment of the prestressing device shown in FIG. 4.

To carry out this prestressing, FIGS. 4 and 5 illustrate, by way of example, two devices which may be used for this purpose.

In order to prestress the upset threaded extremity 4 of a rod 1, for example, there is disposed thereon a threaded support sleeve 11, wherafter the rod thus equipped is immobilized and the extremity 4 concerned is subjected to the action of a jack 6 or the like.

In the case shown in FIG. 4, the extremity 4 of the rod to be prestressed, fitted with its support sleeve 11, is inserted between a bearing plate 7 and extremity 8 of the jack.

When the jack 6 is actuated, the sleeve 11 is blocked against the bearing plate 7 and the jack acts directly on the extremity to be prestressed. Moreover, in order to mark the prestressed extremity, the end 8 of the jack may be fitted with a punch which produces an indelible mark in the region of the upset end 4.

FIG. 5 illustrates a wholly equivalent but inverse procedure, in which there is employed a threaded support sleeve 11 and a bearing plate 7. However, in this case, it is the body of the reinforcing rod 1 which is blocked, by some gripping device shown at 9 in the Figure, and a jack acts on the bearing plate 7 in the direction indicated by the arrows 10, which action is transmitted to the threaded support sleeve 11 to bring about the prestressing of extremity 4.

Depending on the specifications of the standards to be observed, there is effected a prestressing with an equivalent force comprised between 70 and 95% of the elastic limit of the concrete-reinforcing rod.

Thus, this process of producing a reinforcing rod allows to obtain a concrete-reinforcing round 1 or 2, having an upset, threaded and prestressed extremity 4 or 5.

It is obvious that other modes of execution of the present invention, within the reach of the Expert in the Art, could have been referred to without thereby exceeding the scope of the invention.

I claim:

1. Reinforced concrete having reinforcing rods therein, wherein the reinforcing rods comprise:

at least one unitary extremity having an increased strength from a cold-upsetting procedure, said extremity having at least a portion of which threaded, and wherein said threaded portion of said reinforcing rod has a diameter at the depth of thread which is increased from an immediately adjacent portion and extending toward an end of said rod; and means for connecting said reinforcing rod to another reinforcing rod.

2. Reinforced concrete as described in claim 1, wherein the reinforcing rods within the reinforced concrete comprise a mechanical joint which in turn comprises at least two reinforcing rods, wherein a threaded connecting sleeve joins together said reinforcing rods.

3. Reinforced concrete as described in claim 1, wherein the diameter of the concrete-reinforcing rods at the depth of thread are increased by not more than 30 percent over the diameter of the rod at the immediately adjacent portion.

4. The reinforced concrete of claim 1, wherein said threaded portion is prestressed.

5. The reinforced concrete of claim 1, wherein said connecting means comprises an internally threaded connecting sleeve which connects said reinforcing rod to said another reinforcing rod at respective threaded extremities.

6. The reinforced concrete of claim 1 further comprising:

said extremity of said rod having an increased strength from a cold-upsetting procedure; and means for anchoring said reinforcing rod.

7. The reinforcing rod of claim 6, wherein said anchoring means comprises a connection sleeve.

8. The reinforcing rod of claim 6, wherein said anchoring means comprises an anchoring socket.

9. The reinforcing rod of claim 6, wherein said extremity of said rod is prestressed.

10. The reinforced concrete of claim 1 wherein said means for connecting said reinforcing rods comprises a threaded connecting sleeve joining together said concrete-reinforcing rods; and said concrete-reinforcing rods each having at least one extremity having increased strength from a cold-upsetting procedure, said at least one extremity of each reinforcing rod being threaded, wherein said threaded extremities of said reinforcing rods have increased diameters extending at least proximate to ends of said rods, said increase in diameters corresponding to the depth of the threads in said threaded portions.

11. The reinforced concrete of claim 10, wherein said diameters of said concrete-reinforcing rods are increased by not more than 30 percent.

12. The reinforced concrete of claim 10, wherein said diameters of said concrete-reinforcing rods correspond to the depth of said threads produced in said concrete-reinforcing rods.

13. The reinforced concrete of claim 1 further comprising:

each of said concrete-reinforcing rods having at least one extremity extending toward a respective end of said rods which is strengthened by an increase in the diameter of said extremity of not more than 30 percent over the remaining portion of said rod resulting from a cold-upsetting procedure, wherein said strengthened extremity of each of said two reinforcing rods has a threaded portion, and wherein said rod diameter corresponds to a diameter of the depth of said thread; and a threaded sleeve for cooperating with said threaded extremities of said two concrete-reinforcing rods for joining together said reinforcing rods.

14. The reinforced concrete of claim 1 wherein said means for connecting comprises a mechanical joint comprising at least one concrete-reinforcing rod having a nominal diameter and an extremity, said mechanical joint being manufactured by the process of:

cold-upsetting said extremity of said reinforcing rod, thereby strengthening said extremity of said reinforcing rod and increasing the diameter of said reinforcing rod at said extremity toward an end of said rod beyond said nominal diameter;

threading said extremity of said concrete-reinforcing rod to have a diameter of the depth of the thread to be greater than or equal to said nominal diameter; and applying a complementarily threaded connector to said threaded extremity.

15. The mechanical joint of claim 14, wherein said extremity is externally threaded and said connector is internally threaded.

16. The mechanical joint of claim 14, further comprising a second reinforcing rod also being manufactured by said process, wherein said threaded connector is applied to connect together respective threaded extremities of said reinforcing rods.

17. The mechanical joint of claim 14, wherein said reinforcing rod is embedded in concrete.

18. The mechanical joint of claim 14, wherein said threaded connector is an anchoring socket and is applied solely to said reinforcing rod.

19. The mechanical joint of claim 14, wherein said diameter is increased to less than or equal to thirty percent of said nominal diameter.

20. The mechanical joint of claim 14, wherein said diameter is increased to between ten and thirty percent, inclusive, of said nominal diameter.

21. The mechanical joint of claim 14, wherein said process step of threading said extremity of said reinforcing rod comprises creating threads having a bottom, wherein said extremity of said reinforcing rod has a cross-sectional dimension, measured at said bottom of said threads, which is equal to or greater than said nominal diameter.

22. The mechanical joint of claim 14, wherein said process of manufacturing said joint further includes the step of prestressing said extremity of said reinforcing rod.

23. The reinforced concrete of claim 1 wherein said means for connecting comprises a mechanical joint for joining concrete elements comprising:

a joining sleeve with at least one internal cylinder threaded portion;

at least one concrete reinforcing rod having a nominal diameter $\phi$ and at least one extremity adapted to be joined;

said extremity having at least a portion thereof extending from an end of said rod reinforced from a cold-upsetting procedure, said extremity having an external threaded cylindrical portion formed on said reinforced portion adapted to engage said internal cylindrical threaded portion of said joining sleeve;

said reinforced portion having a diameter $d_1$ being greater than said nominal diameter $\phi$; and said external cylindrical threaded portion having a diameter of the depth of thread $d_2$ which is greater than or equal to said nominal diameter $\phi$.

24. The reinforced concrete of claim 1 wherein said reinforcing rod comprises:

a bar having a nominal diameter at two extremities;

at least one of said extremities provided, along at least a portion thereof toward an end of said bar, with a reinforced zone from cold-upsetting, further wherein said reinforced zone is provided with an external cylindrical threaded part;

said reinforced zone having a diameter which is greater than said nominal diameter; and said external cylindrical threaded part having a diameter of the depth of thread greater than or equal to said nominal diameter.

25. A method for making reinforced concrete, the method comprising the steps of:

making reinforcing rods, wherein the reinforcing rods comprise at least one unitary extremity having an increased strength from a cold-upsetting procedure, said extremity having at least a portion of which threaded, and wherein said threaded portion of said reinforcing rod has a diameter of the depth of thread which is increased from an immediately adjacent portion and extending toward an end of said rod, and means for connecting said reinforcing rod to another reinforcing rod; and embedding the reinforcing rods in concrete.

26. A method as described in claim 25 wherein the reinforcing rods within the method further comprises attaching at least two reinforcing rods at a mechanical joint, wherein at the joint a threaded connecting sleeve joins together said reinforcing rods.

27. A method as described in claim 25 wherein the diameter of the concrete-reinforcing rods at the depth of thread are increased by not more than 30 percent over the diameter of the rod at the immediately adjacent portion.

* * * * *